United States Patent [19]

Nybo et al.

[11] 4,007,782

[45] Feb. 15, 1977

[54] PARKING DEVICE FOR BLOWOUT PREVENTER

[75] Inventors: Reidar Oivind Nybo, Hvalstad; Geir Eik, Ski, both of Norway

[73] Assignees: Finn Tveten & Co. A/S; A/S Akers Mek. Verksted, both of Norway

[22] Filed: Mar. 17, 1975

[21] Appl. No.: 558,684

[30] Foreign Application Priority Data

Mar. 18, 1974 Norway ..... 740953
Mar. 11, 1975 Norway ..... 750804

[52] U.S. Cl. ..... 166/79; 166/85; 214/1 BB

[51] Int. Cl.[2] ..... E21B 33/03

[58] Field of Search ..... 166/79, .5, 85; 214/1 BB; 175/5

[56] References Cited

UNITED STATES PATENTS

| | | | |
|---|---|---|---|
| 3,023,808 | 3/1962 | St. John | 166/79 |
| 3,189,093 | 6/1965 | DeVries | 166/.5 |
| 3,333,562 | 8/1967 | Deal, Jr. et al. | 175/5 |
| 3,498,375 | 3/1970 | McEwen et al. | 175/5 |
| 3,612,297 | 10/1971 | Lapostolet | 214/1 BB |
| 3,718,266 | 2/1973 | Donnally | 166/79 |

*Primary Examiner*—James A. Leppink
*Attorney, Agent, or Firm*—Watson, Cole, Grindle & Watson

[57] ABSTRACT

A parking device for containing a blowout preventer aboard a floating drilling station. The parking device includes a parking frame which is capable of holding the blowout preventer with its center of gravity lying above the points at which the blowout preventer is supported on the parking frame. The blowout preventer can be moved as a unit back and forth between a parked position and an installed position for utilization on the drilling station. For enabling such movement a first drive mechanism is provided for raising and lowering the parking frame and additionally a second drive mechanism is provided for moving the parking frame sideways.

10 Claims, 3 Drawing Figures

PARKING DEVICE FOR BLOWOUT PREVENTER

BACKGROUND OF THE INVENTION

The present invention relates to a parking device for a blowout preventer aboard a drilling station such as a rig, platform or vessel.

When drilling for oil from floating drilling platforms or vessels, one is forced to use a so-called "blowout preventer" (BOP) or some sort of valving arrangement in order to be able to prevent any gas and oil found under pressure from freely and incontrollably "blowing" or escaping out into the sea and the consequences this will have. Together with the drilling mud in the drilled hole the BOP can control and prevent any undesirable flow out of the hole by either partly closing off the flow or by cutting the drill string and simultaneously sealing the hole completely.

As the depth of the holes drilled increases, the BOP valve will also increase in size and weight. Blowout preventers exist which weigh about 170 tons and have a height of 14 m.

During installation of the BOP, it is necessary to transport it from its parking place on the main deck (cellar deck) to a position beneath the drill deck (drill floor), where it can be attached to the drill string and be lowered by means of the drill string down to the sea floor. This operation today presents a problem because the clearance between the main deck and the lowest point of the drill floor is not sufficient to allow the BOP to be transported freely in one piece from its parked position to a position below the drill floor where it can be attached to the drill string and lowered down to the sea floor.

During lowering by means of the drill string, the BOP is guided down to an exact position on a foundation which has been lowered down and cemented to the sea floor. The guiding operation is accomplished by four guiding wires, each running through one of four tubes mounted in the four corners of the BOP.

The method presently used is to transport the BOP in two parts. The lower part of the BOP is first-lowered down below the main deck where it is fixed. The upper part is then transported in place and attached to the top of the lower part, so that the BOP can be lowered as a single unit by means of the drill string.

For this purpose various types of traversing cranes are used which are mounted below the drill floor and which can run longitudinally on the platform and thereby transport the two parts of the BOP to the desired position below the drilled floor. These cranes are often equipped with an extra crab having hoisting machinery for performing service on the BOP.

This method for transporting, storing and mounting the BOP is both cumbersome and time-consuming and allows the BOP to be easily subjected to damage. In addition, it is very difficult to give the BOP a functional test before it is mounted. Further problems arise when internal parts of the BOP need replacement, repair or maintenance.

SUMMARY OF THE INVENTION

It is the purpose of the invention to remedy these deficiencies and drawbacks related to transportation, storing, mounting, functional testing, repair and maintenance of large BOP's. This is accomplished by means of a parking device for the BOP. The parking device includes a parking frame which is movable both sideways and vertically and in addition is equipped with a test block and supporting or suspending means. Further features and advantages of the invention will be apparent from the appended claims.

In order to further the understanding of the invention, two embodiments, taken merely as examples, will be described in the following under reference to the accompanying drawings.

DESCRIPTION OF THE PREFERRED EMBODIMENTS

Figure 1:
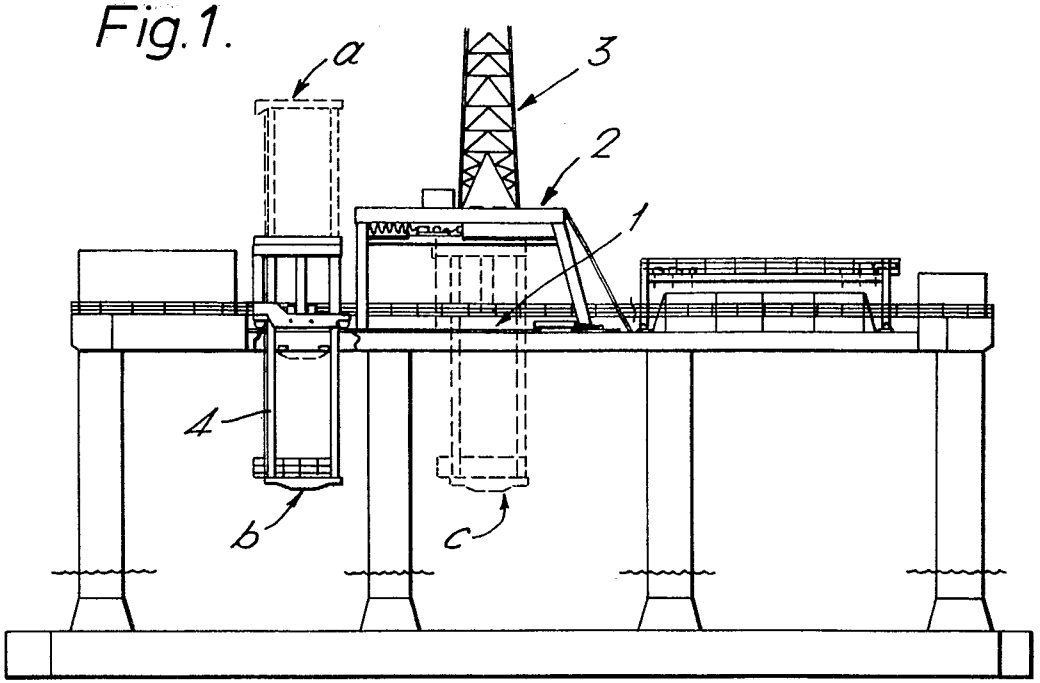
FIG. 1 shows a side view of a floating drilling platform which includes a parking device according to the invention.
Figure 2:
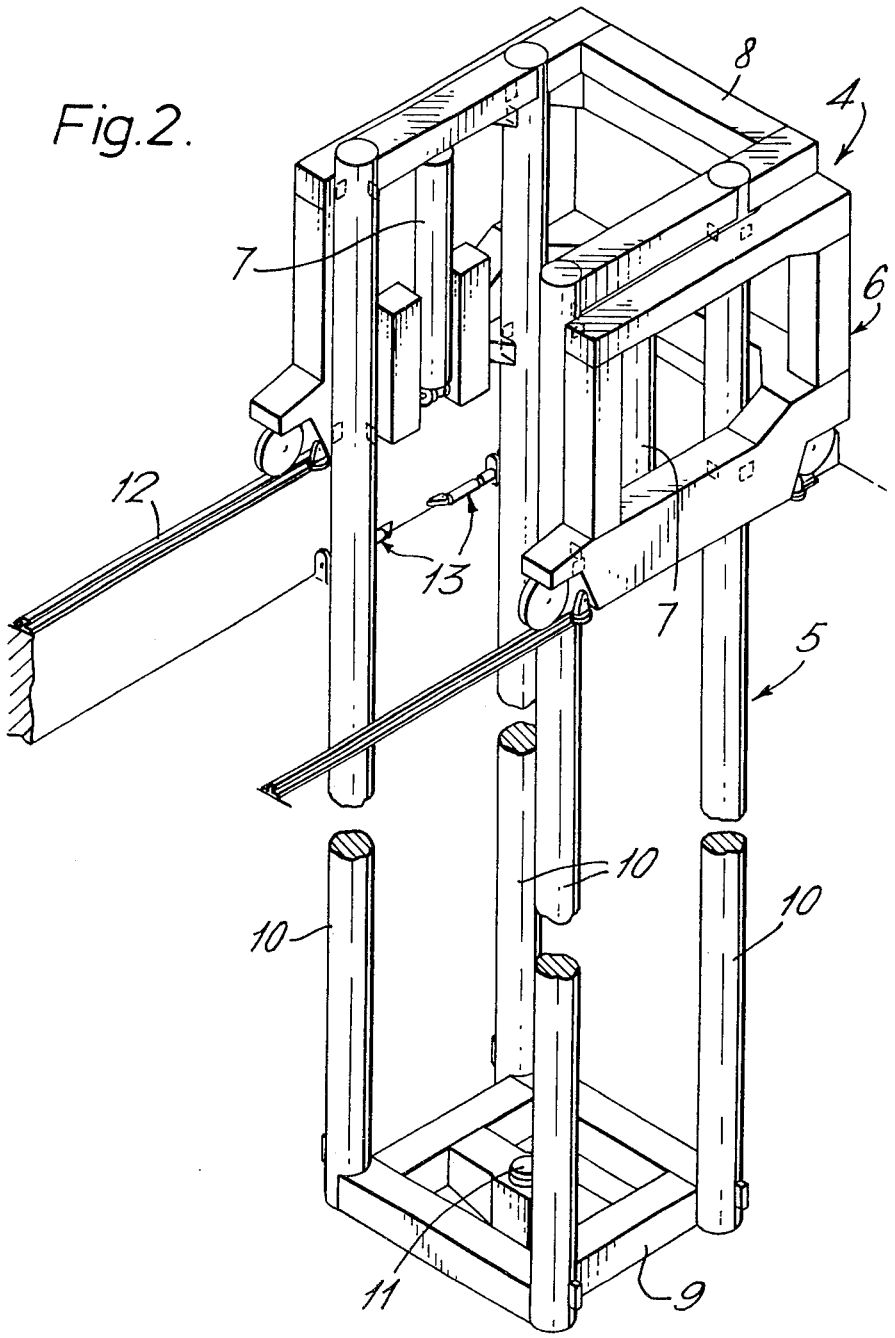
FIG. 2 shows a simplified triangular projection of the parking device according to the invention shown in FIG. 1.

The drilling platform shown in FIG. 1 is of the semi-submersible type. The wavy line indicates the surface of the sea. The drilling platform has a main deck or "cellar deck" 1 and a drill deck or drill floor 2 on which is mounted a drilling tower 3. It is desirable to arrange the drill floor 2 and the drilling tower 3 as low as possible, for reasons of stability, safety etc., and the available clearance between the main deck 1 and the drill floor is therefore limited. The drilling platform is equipped with a parking device for a BOP according to the invention which is generally marked 4. The device is shown in three different positions *a*, *b* and *c*, where *a* and *c* are shown in broken lines. *a* represents the parked position, and *c* the mounting position. The BOP itself is not shown for reasons of clarity. The BOP could have about the same dimensions as the parking device 4. FIG. 2 shows the parking device in more detail. Here the BOP is also deleted for reasons of clarity.

The parking device 4 includes two main parts, namely an inner parking frame 5 and an outer frame or carriage 6. The parking frame 5 is arranged to be raised and lowered in the carriage 6 and is moved by means of telescopic hydraulic cylinders 7. The upper part consists of a U-shaped frame 8 and the lower part consists of a bottom frame 9. The frames 8 and 9 are mutually connected by means of four columns 10. In the middle of the bottom frame 9 a testing block or "test stump" 11 is arranged upon which the BOP can be placed. The testing block 11 may consist of a lower cylindrical section continuing in a upper section having the form of a truncated cone. The BOP will fit closely around the testing block and can be subjected to high test pressures in this position.

The opening of the U-shaped frame 8 faces the drill string. The same is true for the outer frame or carriage 6. The carriage is equipped with wheels and can move horizontally on rails 12. The rails 12 encloses an opening in the main deck 1, which opening extends from the drill string out past the periphery of the drill floor.

The exemplary embodiment of the invention as described above functions as follows:

In the parked position the parking frame 5 rests in position *a*. Both the parking frame and the BOP is then out of the way for large waves, supply ships etc. that might be present under the main deck 1. In this position, the parking frame 5 is locked to the main deck by means of locking devices 13, and the BOP is in turn secured to the parking frame. The BOP rests on the testing block and can be subjected to any desirable functional test.

When installing BOP, the parking frame is first released from the main deck, and then lowered by means of the hydraulic rams 7 from position a to position b. Thereafter, the parking device 4 including the BOP is driven in under the drill floor 2 until the BOP is in the correct position below the drilling tower 3. The drill string is attached to the BOP which then is lifted sufficiently to clear the testing block 11. Thereafter, the parking device is driven back so that the BOP can be lowered freely down to the bottom of the sea by means of the drill string. For removal and parking of the BOP, these operations are carried out in opposite order.

Figure 3:
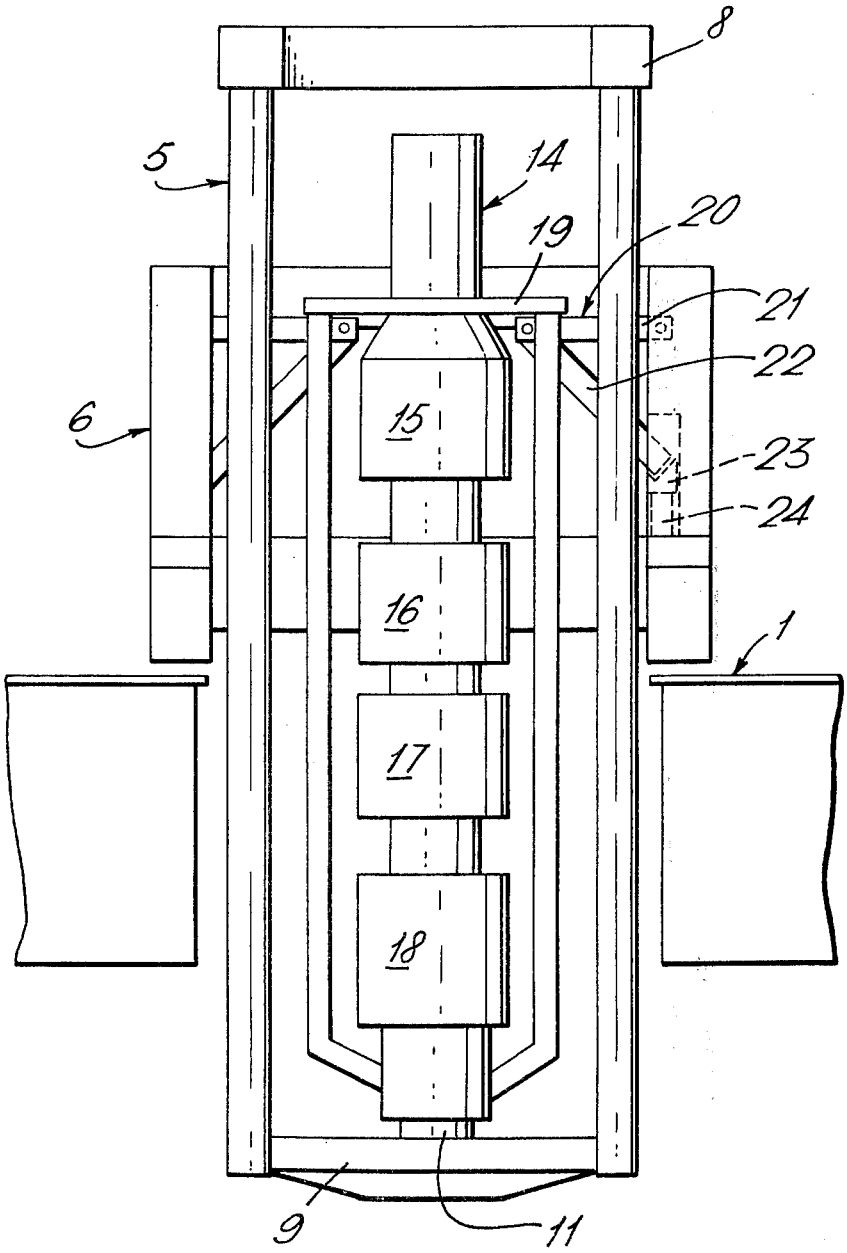
FIG. 3 shows schematically a modified parking device according to the invention and a BOP.

On FIG. 3 a modified parking device in which a BOP 14 is placed as schematically shown. The BOP 14 consists of a number of valves and other elements 15, 16, 17, 18 which are bolted together with gaskets or other interposed sealing elements. The top section of the BOP is equipped with a flange-like plate 19.

The carriage 6 is equipped with movable supporting devices 20 which in the position shown extend in between the columns 10 and in under the plate 19.

When the need arises to change a sealing element between two BOP elements, for instance the elements 15 and 16, the respective bolts are first loosened. Then the frame 5 is lowered, and thereby the lower part of the BOP consisting of the elements 16, 17 and 18 is lowered while the top part remains suspended by the supporting devices 20. Hereby sufficient space is obtained between the elements 15 and 16 for the sealing element to be changed or for performing other maintenance or repair work without disassembling the entire BOP.

The supporting devices 20 consist in the illustrated embodiment of two arms 21 and 22 which at one of their ends are linked together. The other end of the arm 21 is linked to the carriage 6 so that the arm can be pivoted in a substantially vertical plane. The other end of the arm 22 is bearing against a corresponding rest 23 in the carriage 6. This rest is equipped with adjusting means 24 so that it can be adjusted in the vertical direction in order to facilitate bringing all the supporting devices in correct position against the plate 19 before the frame 5 is lowered.

When the supporting device is no longer in use, the other end of the arm 22 is lifted away from the rest, and the arms 21 and 22 can be pivoted down and out of the way of the frame 5.

It will be obvious to the skilled person that the embodiments shown by way of example can be varied in several ways within the scope of the invention. This is true for instance for the form of both the supporting devices and their attachment with possible adjustment means. The supporting devices can also be replaced by suspending means giving similar effect, or they can consist of a bracket which can be lifted or pivoted to and from working position. The elevation adjustment of the supporting devices can also be performed by adjusting the length of one or more constituents and/or displacement of their supporting points. The supporting device can also consist of a generally upwardly pointing arm which at its lower end is pivotably attached to the carriage 6 and pivotably attached at the top to one end of a generally horizontal hydraulic ram device or the like, the other end of which is pivotably attached to the carriage 6, the hydraulic ram device being able to move the supporting arm between its respective positions when in use and out of use. The supporting devices can also be used to hold the BOP in place in the frame when the BOP is not undergoing maintenance or repair.

We claim:

1. A parking device for a blowout preventer mounted for movement aboard a floating drilling station, the device comprising: a parking frame adapted to hold the blowout preventer with the center of gravity of the blowout preventer lying above the points at which the blowout preventer is supported on said parking frame, said parking frame at its lower portion is equipped with a testing block upon which the blowout preventer can rest, thereby allowing functional testing of the blowout preventer in a non-installed position; and control drive means for moving the blowout preventer as a unit back and forth between a parked position and an installed position for utilization on the drilling station, said control drive means including first drive means for raising and lowering said parking frame and second drive means for moving said parking frame sideways.

2. A parking device according to claim 1, wherein said drilling station has a drill floor and a main deck and said parking frame is arranged to be moved from an installation position below said drill floor to a parking position adjacent to said drill floor on said main deck with the blowout preventer remaining in said parking frame during storage.

3. A parking device according to claim 1, further comprising locking means arranged for locking said parking frame to said drilling station.

4. A parking device according to claim 1, wherein said second drive means includes a horizontally movable frame, said first drive means is coupled to said movable frame and said movable frame is equipped with at least one support member for supporting a blowout preventer arranged in said parking frame.

5. A parking device according to claim 4, wherein said support member is movable relative to said movable frame.

6. A parking device according to claim 4, wherein said support member includes first and second arms having one of their ends connected to each other and their other ends coupled to said movable frame.

7. A parking device according to claim 6, wherein both the connection between said ends of said arms and the coupling between said other end of said first arm and said movable frame are pivotable.

8. A parking device for a blowout preventer mounted for movement aboard a floating drilling station, the device comprising: a parking frame adapted to hold the blowout preventer with the center of gravity of the blowout preventer lying above the points at which the blowout preventer is supported on said parking frame, said parking frame comprising a plurality of vertical columns, a bottom frame attached at the lower portion of said columns, a testing block fixed on said bottom frame, and an open U-shaped frame attached to the top portion of said columns; and control drive means for moving the blowout preventer as a unit back and forth between a parked position and an installed position for utilization on the drilling station, said control drive means including first drive means serving to raise and lower said columns and thus said parking frame and second drive means for moving said parking frame sideways, second drive means including a horizontally movable frame and said first drive means being coupled between said parking frame and said movable frame for raising and lowering of said parking frame.

9. A parking device according to claim 8, wherein said horizontally movable frame is adapted to be moved along a plurality of guides arranged on the drilling station.

10. A parking device for a blowout preventer mounted for movement aboard a floating drilling station, the device comprising: a parking frame adapted to hold the blowout preventer with the center of gravity of the blowout preventer lying above the points at which the blowout preventer is supported on said parking frame and control drive means for moving the blowout preventer as a unit back and forth between a parked position and an installed position for utilization on the drilling station, said control drive means including first drive means for raising and lowering said parking frame and second drive means for moving said parking frame sideways, said second drive means including a horizontally movable frame and said first drive means being coupled between said parking frame and said movable frame for raising and lowering of said parking frame, said movable frame being equipped with at least one support member for supporting a blowout preventer arranged in said parking frame, said support member being movable relative to said movable member, said support member including first and second arms having one of their ends connected to each other and their other ends coupled to said movable frame, both the connection between said ends of said arms and the coupling between said other end of said first arm and said movable frame being pivotable, and said movable frame has a rest member upon which a lower end of said second arm is adapted to bear when in use.

* * * * *